United States Patent [19]

Jahns et al.

[11] 4,325,655

[45] Apr. 20, 1982

[54] MULTIPLE SLOPE STRUCTURE

[75] Inventors: Hans O. Jahns; Richard T. Weiss, both of Houston, Tex.

[73] Assignee: Exxon Production Research Company, Houston, Tex.

[21] Appl. No.: 112,501

[22] Filed: Jan. 16, 1980

[51] Int. Cl.[3] ..... E02B 17/00

[52] U.S. Cl. ..... 405/217; 405/61

[58] Field of Search ..... 405/217, 195-209, 405/211-214, 61

[56] References Cited

U.S. PATENT DOCUMENTS

| | | | |
|---|---|---|---|
| 3,645,104 | 2/1972 | Hogan . | |
| 3,745,777 | 7/1973 | Blenkarn . | |
| 3,793,840 | 2/1974 | Mott et al. . | |
| 3,831,385 | 8/1974 | Hudson et al. | 405/217 |
| 3,952,527 | 4/1976 | Vinieratos et al. | |
| 3,972,199 | 8/1976 | Hudson et al. | |
| 4,080,798 | 3/1978 | Reusswig et al. | 405/217 |
| 4,239,418 | 12/1980 | Pearce | 405/217 X |
| 4,245,929 | 1/1981 | Pearce et al. | 405/211 |
| 4,265,569 | 5/1981 | Gefvert | 405/217 |

FOREIGN PATENT DOCUMENTS

| | | |
|---|---|---|
| 2017793 | 10/1979 | United Kingdom . |
| 2017794 | 10/1979 | United Kingdom . |
| 2018700 | 10/1979 | United Kingdom . |

OTHER PUBLICATIONS

Gerwick, B. C. and Lloyd, R. R., "Design and Construction Procedures for Proposed Arctic Offshore Structures", Offshore Technology Conference, OTC Paper No. 1260, Apr. 1970.

Danys, J. V., "Effect of Cone-Shaped Structure on Impact Forces of Ice Floes", Proceedings of Port and Ocean Engineering Under Arctic Conditions, Trondheim, Norway (1971), vol. I, pp. 609-620.

AMDS-Arctic Mobile Drilling Structure, Preliminary Design Package, by Chevron Research Company, Apr. 1978.

Hancock, J. A. et al., "Preliminary Design of the Arctic Mobile Drilling Structure", Proceedings of the Port and Ocean Engineering Under Arctic Conditions, Trondheim, Norway, Aug. 12, 1979.

Pearce, J. C. and Strickland, G. E., "Ice Forces on Conical Structures", Offshore Technology Conference, OTC Paper No. 3635, Apr. 1979.

Stenning, D. G. and Schumann, C. G., "Arctic Offshore Deepwater Ice Structure Interactions", Offshore Technology Conference, OTC Paper No. 3630, Apr. 1979.

Bercha, F. G. and Stenning, D. G., "Arctic Offshore Deepwater Ice-Structure Interactions", Offshore Technology Conference, OTC Paper No. 3632, Apr. 1979.

*Primary Examiner*—Dennis L. Taylor

*Attorney, Agent, or Firm*—Marc L. Delflache

[57] ABSTRACT

An improved offshore arctic structure is disclosed which controls the horizontal forces exerted by impinging ice masses. The structure includes lesser sloped wall sections near the sea floor and steeper sloped wall sections near the water surface. Thus, the deep pressure ridges contact the lesser sloped wall sections and the shallower ice sheets contact the steeper sloped wall section. The slope of all wall sections is chosen so as to keep all horizontal loads due to impinging ice masses below a preselected design maximum.

9 Claims, 12 Drawing Figures

MULTIPLE SLOPE STRUCTURE

BACKGROUND OF THE INVENTION

1. Field of the Invention

This invention relates to an improved offshore structure for use in an arctic environment. More particularly, this invention relates to an offshore structure having a multiple slope surface which controls the impinging horizontal forces due to moving ice sheets of various thicknesses.

2. Description of the Prior Art

The offshore polar regions of the world, particularly the arctic, are hostile environments for offshore structures. Continuously moving ice masses pose a threat to the successful operation of an offshore structure. Ice sheets and ice floes of 10 feet or more in thickness are fairly common in these polar regions. Occasionally, these sheets or floes crush against one another and produce an irregular ridge of ice rubble commonly referred to as a pressure ridge. If a pressure ridge is sufficiently large it may survive the summer melt period and become a multiyear pressure ridge. Investigations have revealed multiyear pressure ridges consisting of solid ice more than 100 feet thick.

These ice floes and ridges cover most of the Arctic Ocean. They move relatively slowly; however, when they move against a stationary offshore structure they may exert very large forces on it. The load from large formations of solid ice such as multiyear pressure ridges will generally determine the design load for the structure. Conical structures are designed so as to break ice by bending it upward and deflecting it around the structure.

In simple terms, there are three basic types of ice failures possible: crushing, shearing and bending. Crushing failures exert the greatest force on a structure due to the high compressive strength of ice (500 to 1000 pounds per square inch (psi)). For this reason, it is desirable to avoid crushing failures of the ice. This can be accomplished by providing a structure which has a slanting or sloping exposed surface at and below the waterline. This slanting or exposed surface bends the ice as it impinges on the structure and causes a bending failure. The shearing failure generally occurs after the crushing mode failure has begun.

Previous conical structures proposed for the arctic offshore typically employ a single-slope surface to fail the ice in bending. Sloped surfaces produce a bending mode failure because the ramp-like surface causes the edge of the moving ice to be forced upward, and it has generally been found that the horizontal forces exerted on a sloped structure are substantially less than the forces exerted against a vertically oriented surface.

Conical structures having a single slope below the waterline have been used as lighthouses and light piers in Lake Erie and along the St. Lawrence River for many years (see "Effect of Cone-Shaped Structures on Impact Forces of Ice Floes", by Danys, J. V., Proceedings of Port and Ocean Engineering Under Arctic Conditions, Trondheim, Norway, 1971, Vol. 1, pp 609–620). Additional single-slope configurations for resisting ice forces are illustrated in U.S. Pat. Nos. 3,645,104; 3,745,777; 3,793,840; 3,831,385 and 3,952,527. These references disclose a single slope which extends from substantially the sea bottom to a deflector zone at or near the water surface. When installed for use in the arctic, these structures would, typically, have to be designed for the load that a relatively thick pressure ridge would exert; however, they would then be overdesigned near the water surface for the more common relatively thin ice sheets which exert lesser loads. Therefore, the need exists for an improved offshore structure which is designed to handle the loads of thick as well as thin ridges without being overdesigned.

SUMMARY OF INVENTION

Recognizing the need for an improved offshore structure which extends from the sea floor to above the water surface and is capable of controlling the loads due to floating ice masses of various thicknesses, applicants have invented an offshore arctic structure with an outer surface or wall designed to engage the ice masses as they impinge on the structure. This wall or surface comprises a plurality of upper and lower wall sections of different slopes extending inwardly and upwardly from the sea floor to a deck structure above the water surface. The slope of each successive wall section from the sea floor to the water surface increases. Thus, the thicker ice masses, or pressure ridges, which extend deeper into the water contact the lesser sloped or lower wall sections proximate the sea floor while the thinner ice masses near the water surface contact the steeper sloped or upper wall sections. In this manner, the impinging lateral load resulting from the various thicknesses of ice masses is controlled. Theoretically, a continuously varying slope would be the best configuration; however, from a fabrication standpoint it would be difficult and expensive to construct.

The preferred embodiment of the invention is actually a bi-sloped structure. In other words, the structure has a single break in its profile defining a lower wall section having a first slope which extends from the sea floor upwardly and an upper wall section having a second slope greater than the first slope. The deeper or thicker ice masses initially contact the lower wall section while the shallower or thinner ice masses initially contact the upper wall section. The upper and lower wall sections collectively form a supporting substructure for the deck.

Thus, the invention controls the lateral loads created during encounters with pressure ridges. The large pressure ridges most easily broken on the lesser sloped surfaces. The slopes of the upper wall sections on which the thinner ice sheets or floes fail are greater than the slopes of the lower wall sections on which the thick pressure ridges fail. In this manner, the pressure ridges exert the same lateral load on the lesser sloped or lower wall sections that the ice floes exert on the steeper sloped or upper wall sections.

BRIEF DESCRIPTION OF THE TABLES AND DRAWINGS

In the drawings, wherein like reference numerals indicate like parts and wherein illustrative embodiments of this invention are shown:

Figure 7:
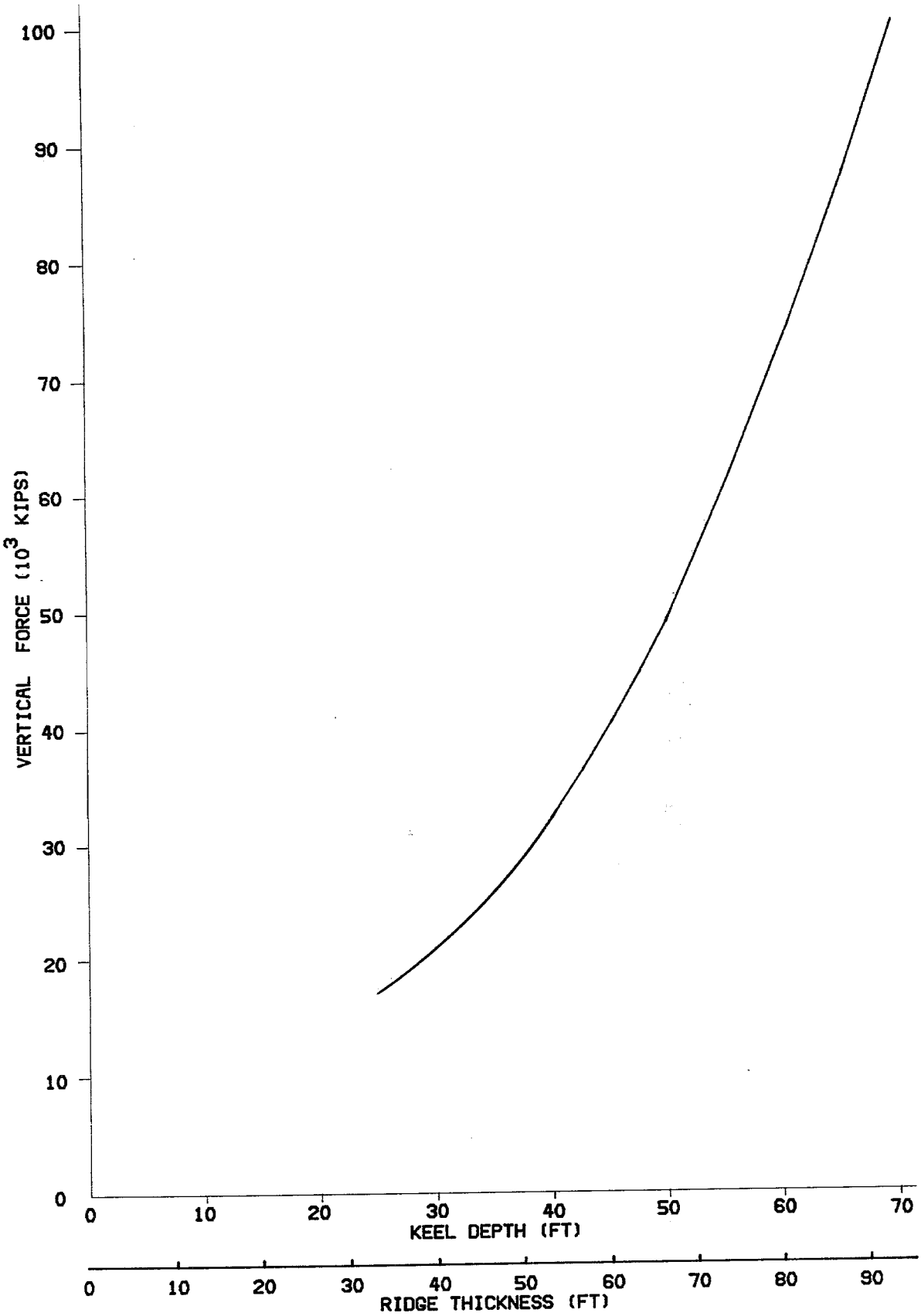
FIG. 7 is a graph illustrating the vertical force exerted by various sizes of ice ridges.

Table I illustrates the data used to generate FIG. 7 and indicates the vertical deflection of the edge of an ice sheet at the time of failing.

Figure 8:
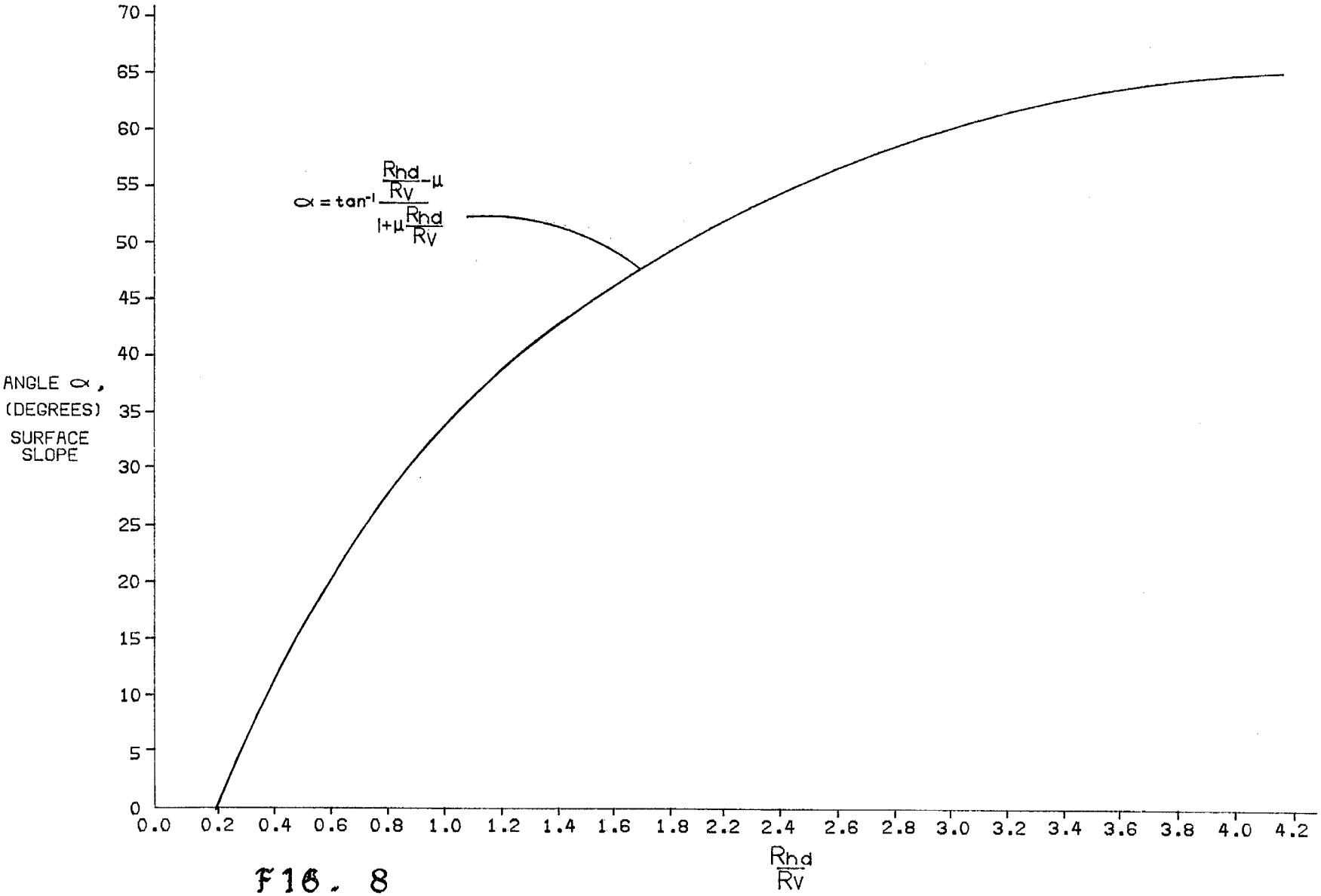
FIG. 8 is a graph of the ratio of vertical force to horizontal force versus the angle or slope of the structure's surface.

Table II illustrates additional data compiled from Table I and FIGS. 7 and 8.

DETAILED DESCRIPTION OF THE INVENTION

Basically, applicants' invention is directed to a multiple slope structure having an upwardly and inwardly sloping outer wall to engage advancing ice masses. This wall comprises a plurality of wall sections between the sea floor and water surface. The slopes of the wall sections are chosen so as to control the lateral load exerted on the structure by pressure ridges. Occasionally, the invention will be spoken of as a conial structure. However, the elevation or profile of the structure may be viewed as a series of smaller frustum-shaped elements having progressively steeper sloped wall sections. Moreover, the term conical generally connotes a circular plan when seen from a horizontal, cross-sectional view. It is understood, however, that the structure may be any polygon shape when seen in a cross-sectional view.

As discussed above, crushing failures exert the dominate force on a structure for design purposes due to the fairly high compressive strength of ice. For this reason, crushing failures are avoided by slanting or sloping the exposed surface to produce bending failure.

Figure 1:
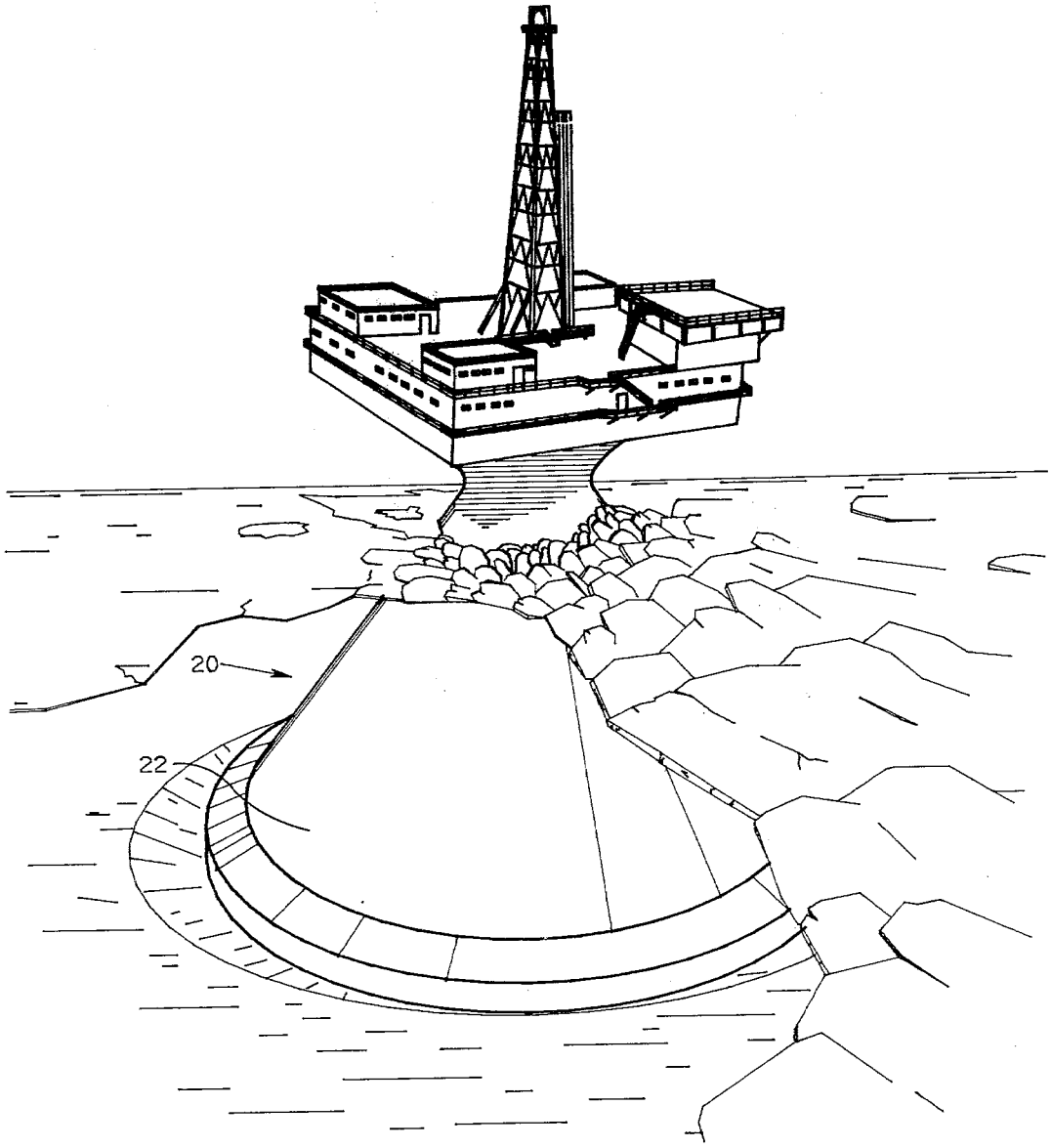
PRIOR ART FIG. 1
FIG. 1 is a perspective view of a prior art structure.

FIG. 1 shows a perspective view of a prior art structure 20 with a single-slope surface 22 to accommodate ice masses of all thicknesses. As mentioned above, the horizontal forces which result from ice of substantially different ice thicknesses striking a single slope varies. Thus, a single-slope structure designed to withstand the forces generated by a thick mass impinging on the structure will be overdesigned for the thinner masses.

The present invention has a plurality of wall sections with different slopes which are selected so that impinging ice masses generate substantially the same lateral load against the structure.

Figure 2:
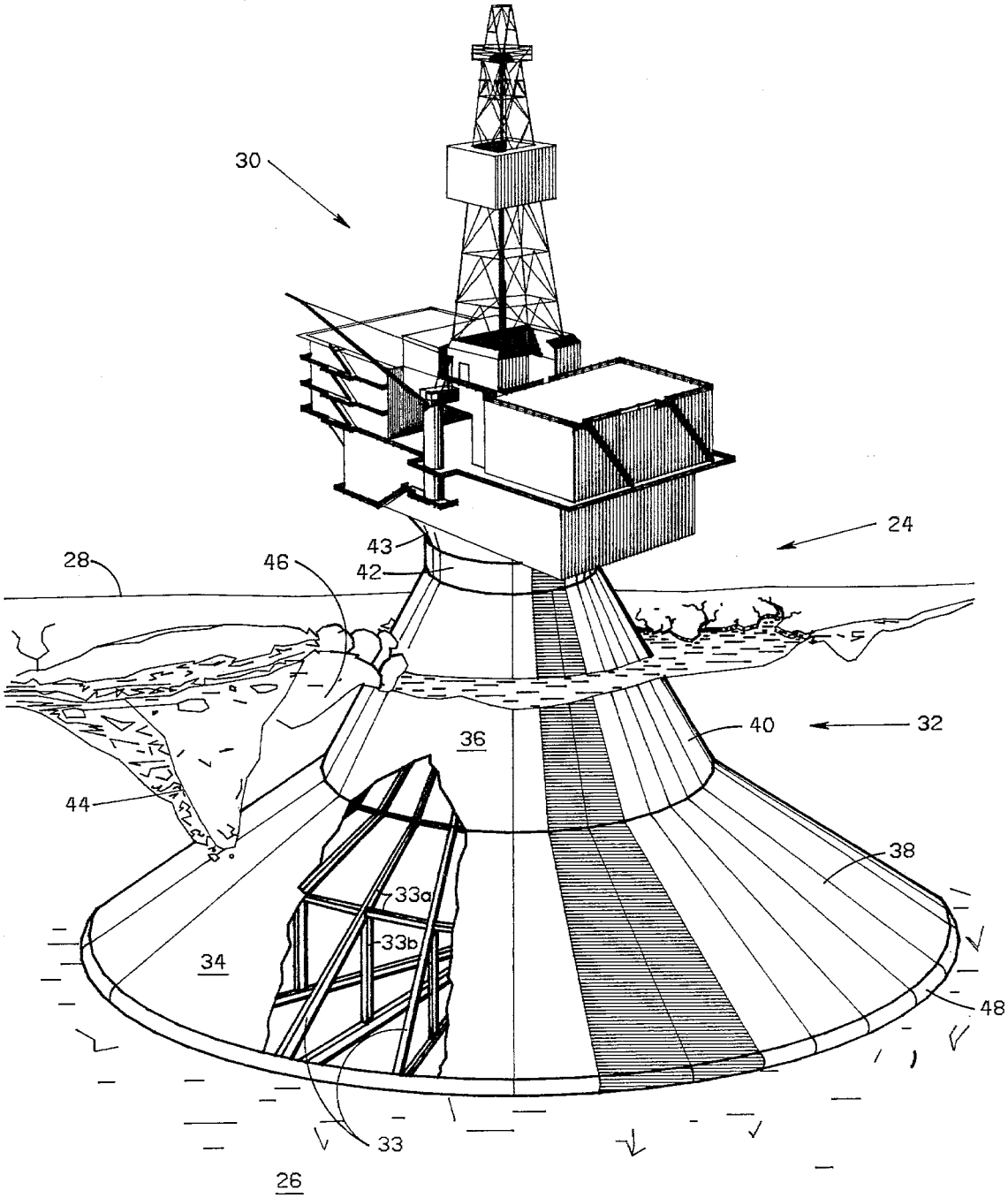
FIG. 2 is a perspective view of a structure designed in accordance with a preferred embodiment of the present invention.

The preferred embodiment is shown in FIG. 2. An offshore arctic structure 24 is illustrated which extends from the sea floor 26 to above the water surface 28. The structure 24 includes a superstructure 30, commonly referred to as a deck, and a substructure 32 which supports the deck above the water surface. The substructure 32 includes a foundational base 48, capable of contacting the sea floor, and an internal frame assembly 33 extending from the base upwardly. The frame assembly is the basic structural reinforcement to resist the lateral and vertical forces of advancing ice sheets. It is also the principal support means for the superstructure. As illustrated, the assembly comprises beams 33*a* and columns 33*b*. However, the assembly may be any rigid form of internal support, such as a series of internal radial and circumferential bulkheads or a single mass of concrete.

As illustrated in FIG. 2, the substructure 32 also includes outer wall sections 38 and 40 which circumscribe the frame assembly 33 and define an upper portion 36 of the substructure and a lower portion 34 of the substructure. In the case of the lower portion 34, the wall section 38 extends from the foundational base 48 to the upper portion 36. And in the case of the upper portion, the wall section 40 extends from the lower portion 34 to above the water surface 28. The substructure 32 also includes a vertical section 42 which extends from the upper portion 36 to the deck 30. The substructure may also include a diverging section 43 which would extend from the vertical section 42 to the deck 30; however, such may not be necessary. The vertical section 42 may contact and support the deck 30 directly.

The multiple slope nature of the present invention is illustrated by the slopes of the wall sections 38 and 40. The lower wall section 38 has a lesser slope than the upper wall section 40. Thus, a deeper or thicker pressure ridge 44 initially contacts the lower wall section 38 and is lifted upwardly in a bending attitude. On the other hand, thinner or shallower ice masses 46 which do not extend as far down into the water as the pressure ridge 44 pass over lower wall section 38 and initially strike the upper wall section 40. Both ice masses ride up the sloped wall sections slightly and eventually fail in the bending mode.

Figure 3:
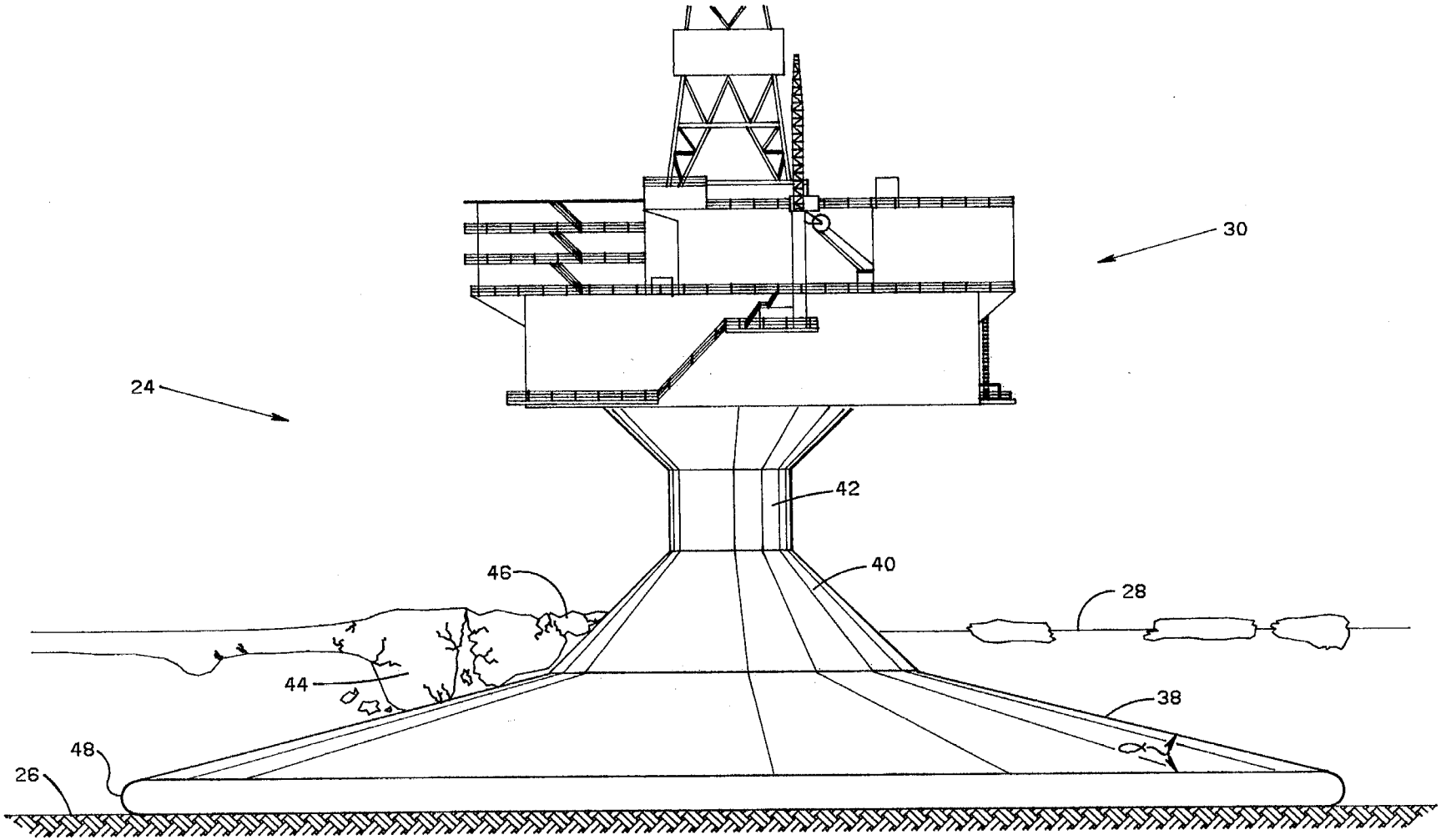
FIG. 3 is an elevation view of a structure designed in accordance with the preferred embodiment of the present invention.

FIG. 3 is an elevation view of the invention as illustrated in FIG. 2. The structure 24 is gravity-based. In other words, the structure does not include a series of piles independent of the base which extend into the sea floor. The structure's resistance to horizontal load is achieved by its overall weight and the friction between the surface of the soil at the sea floor 26 and the foundational base.

Figure 4:
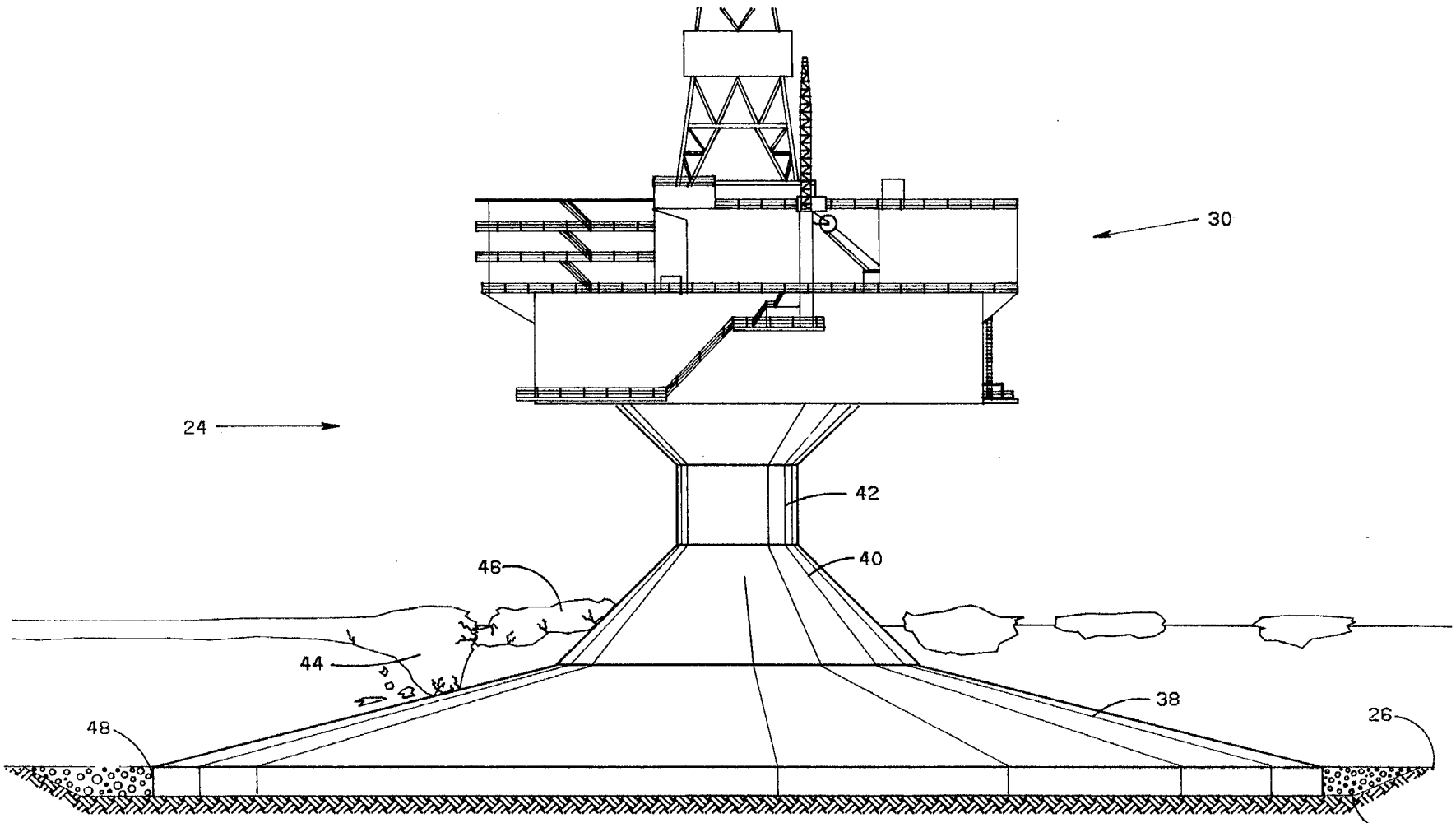
FIG. 4 is an elevation view of a structure designed in accordance with the preferred embodiment of the present invention having a slightly modified foundational design.

Alternatively, the foundational base of the structure may be embedded a predetermined amount into the sea floor 26 as illustrated in FIG. 4. Where practical, embedment of the foundational base is preferred for several reasons. First, the lateral stability of the structure is enhanced by the amount of resistance which the soil or gravel 50 immediately adjacent the embedded portion of the base exerts. The soil immediately adjacent the base may be excavated and replaced with gravel to prevent erosion of the soil from around the base due to wave and current scour. Second, damage to the bearing capacity of the soil immediately beneath the foundational base of the structure due to wave or current scour is minimized since a larger amount of soil and gravel must be eroded before the soil beneath the base is affected. And, in addition, embedment improves the stability of the structure by permitting a structure taller than the depth of the water and, therefore, the maximum ice mass expected since ice masses may be as deep as the water depth.

Figure 5:
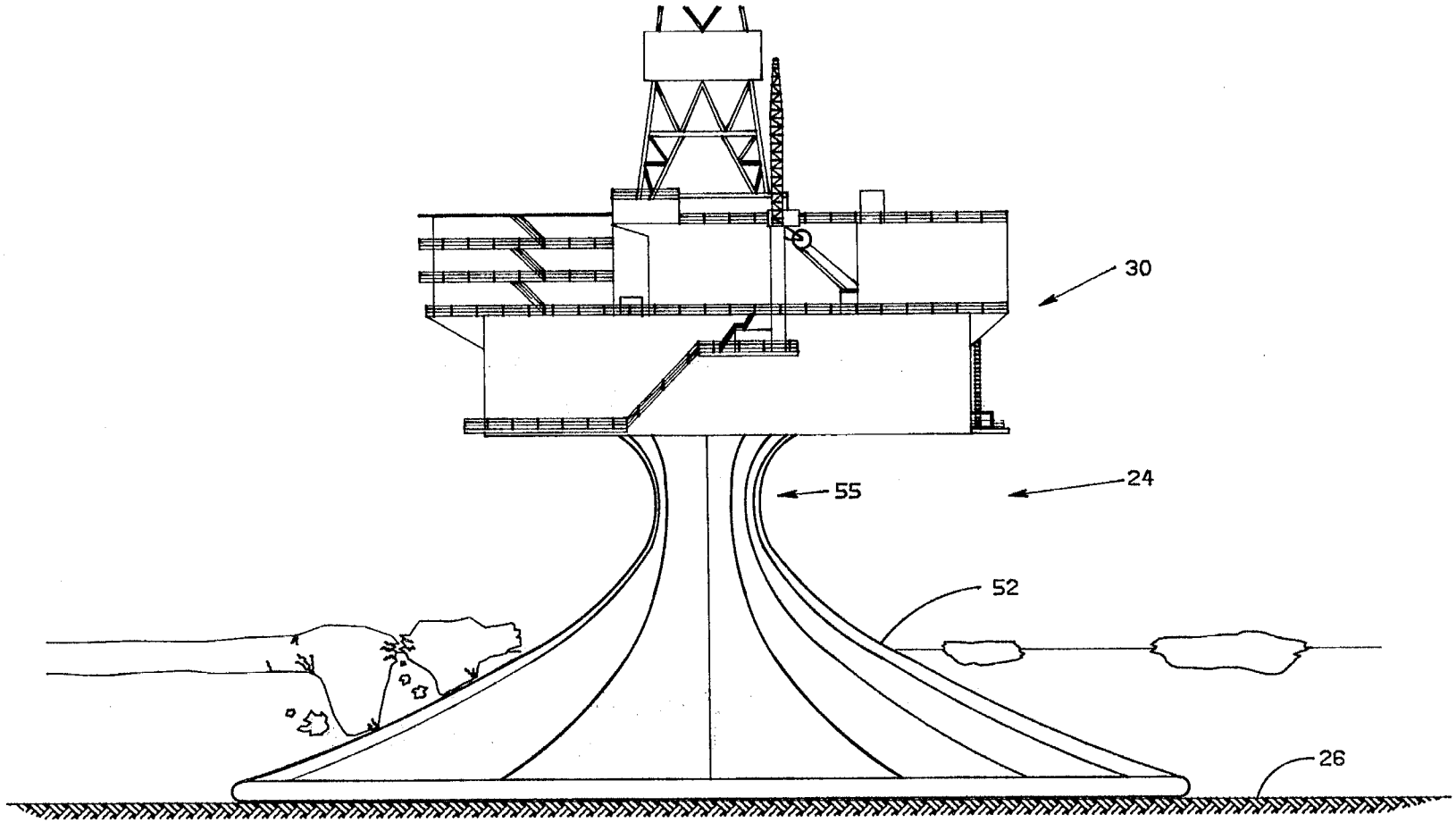
FIG. 5 is an elevation view of a structure designed in accordance with an alternate embodiment of the present invention.

FIG. 5 illustrates an alternate embodiment of the present invention having a continuously varying upwardly and inwardly outer sloping wall surface 52. The wall surface 52 increases in slope from the sea floor to the water surface. Thus, the wall surface includes a lesser sloped portion nearer the sea floor and a steeper sloped portion nearer the water surface. Once again, the slope is chosen so that the pressure ridges or thicker ice masses initially engage the lesser sloped portion while the ice floes or thinner ice masses initially engage the steeper sloped portion. The wall surface 52 converges toward a neck region 55 located above the water surface. The wall surface 52 may then diverge outwardly to provide enough surface area to support the superstructure 30 and to deflect ice riding up the cone surface. Alternatively, the superstructure may be attached to the substructure at the neck region 53 if there is sufficient supporting area and if it is determined that ice will not ride-up against the underside of the deck. As discussed above, a continuously varying upwardly and inwardly outer sloping wall surface is, theoretically, the best. However, from a fabrication standpoint it is difficult and expensive to construct. Yet, the final chosen shape should approximate this slope to one degree or another.

Figure 6:
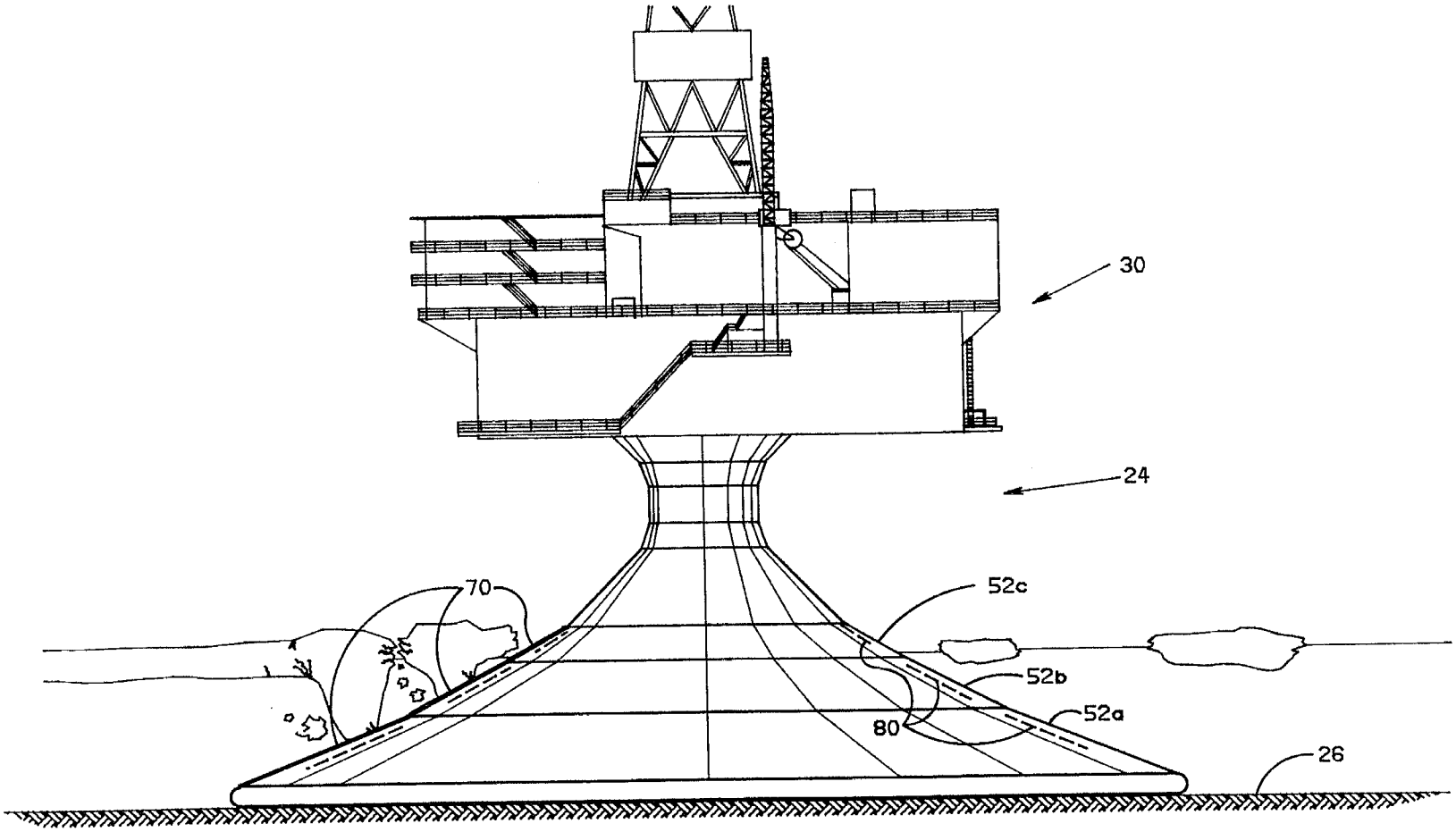
FIG. 6 is an elevation view of a structure designed in accordance with another alternate embodiment of the present invention.

FIG. 6 illustrates yet another alternate embodiment of the present invention and features a plurality of upwardly and inwardly sloping wall sections 52*a*–52*c* which extend from the sea floor to above the water surface. A plurality of sloped wall sections has the advantage of accommodating several sizes of ice ridges. As the number of sloped wall sections increases, the slope begins to approximate a continuously varying sloped wall surface as illustrated in FIG. 5.

The shape of the invention (number of sloped wall section and the slope of each wall section) is based on a relationship between the maximum horizontal or lateral force due to the largest anticipated pressure ridge at the proposed site and the vertical force on the structure when that pressure ridge breaks. The vertical force is a function of several parameters, specifically the size and strength of the ice ridge. An understanding of applicants' invention is best appreciated by a discussion of the design methodology used in selecting the number of wall sections and the slope and height of each wall section.

DESIGN METHODOLOGY

The design methodology requires (i) the determination of the vertical force required to break an ice ridge and (ii) an iterative process to determine the shape of the structure.

First, it is necessary to specify properties of the design pressure ridges as a function of ridge thickness. These properties include the cross-sectional shape of the ridge and the mechanical properties of the ice in the ridge. These specifications, which should reflect prudent engineering knowledge and judgment of the properties of multiyear ice ridges likely to be encountered, are generally available to the public and well known to those skilled in the art.

Next, the maximum vertical force necessary to break-up a ridge of a known size is determined. This should be done for a series of ridge thicknesses ranging from slightly greater than the typical multiyear ice sheet or ice floe thickness up to and including the maximum ridge thickness corresponding to the design pressure ridge.

Various methods exist for calculating the vertical force as a function of ridge thickness. One method is discussed in *Beams On Electric Foundation* by Heteny, M., University of Michigan Press, Ann Arbor, Michigan, 1971. This elastic theory relates force, deflection and stress to the properties of the material under study. It is assumed that the fracture occurs when the bending or flexural stress in the ice reaches the bending or flexural failing strength of ice. More than one bending failure will probably occur as the ridge moves past the structure. Where the long axis of the ridge is approximately perpendicular to a line extending radially from the center of the structure and the ridge is moving toward the structure approximately perpendicular to its long axis, the ridge will first develop a crack in a vertical plane through the point of contact between the ridge and the structure. This crack will divide the ridge into two pieces. Each of these pieces will then fail a second time as they bend upward by further movement. Forces on the structure prior to this second failure will typically be greater than those due to the initial failure. An example of this failure process occurring in model tests is presented in a paper entitled "Modeling the Interaction Between Pressure Ridges and Conical Shaped Structures" by J. W. Lewis and K. R. Croasdale, and presented at the IAHR Symposium on Ice Problems in Lulea, Sweden on Aug. 7–9, 1978.

If the ice ridge pieces resulting from the second failure are sufficiently constrained by the surrounding ice, they may be forced to ride further up the cone and fail again, resulting in an even greater force on the structure. From model test studies, the occurrence of this third fracture or failure load process is rare. For each step in the failure process the theory of beams on elastic foundation can be used to estimate the forces on the structure when the ridge (beam) fails. FIG. 7 shows the results of such calculations for a range of ridge thicknesses. In order to provide a conservative estimate of the maximum vertical forces on the design structure, it was assumed that the third ice fracture load would occur in generating the curve in FIG. 7. Illustrated on the abscissa of FIG. 7 is the keel depth of the ridge. Keel depth is defined as the maximum depth which the ridges extend into the water. The total ridge thickness is typically 30% larger than the keel depth. This increase is primarily due to the density of ice which is less than water and, therefore, floats. Each pressure ridge thickness plotted in FIG. 7 is actually the total of both the pressure ridge thickness and the ice floe thickness near the water surface since these are actually an integral mass. Whenever a pressure ridge is present it will include a certain thickness of surface ice which is similar in thickness to the surrounding ice sheet.

Other methods such as finite element analysis or plastic limit analysis can be used to determine the vertical pressure ridge force as a function of ridge size. Such methods are well known to those skilled in the art.

Once a relationship between the vertical force and ridge thickness is established, the final shape of the structure is determined. Briefly, the design methodology can be summed up by the following outline which highlights the iterative process:

(a) select the horizontal design force, $R_{hd}$;
(b) determine the preferred profile for the structure based on the range of pressure ridges used to determine the vertical force relationship mentioned above;
(c) determine the base area of the structure from the range of pressure ridges;
(d) determine foundation stability; and (e) if foundation loads are too high, reduce the horizontal design force and repeat steps (b)–(e); if foundation loads too low (excessive factor of safety) increase the horizontal design force and repeat steps (b)–(e).

An appropriate selection for the horizontal design force is between 20 and 100 percent of the vertical force on the structure from the design ridge.

For the range of pressure ridges for which vertical failure forces were determined, the corresponding maximum slope angle $\alpha$ for each wall section is calculated using the following equation:

$$\alpha=\tan^{-1}(R_{hd}/R_v-\mu)/(1+\mu R_{hd}/R_v) \quad (1)$$

where $\alpha$ is the maximum slope angle for the respective wall section;

$R_{hd}$ is the selected horizontal design force;

$\mu$ is the coefficient of friction between ice and the outer surface of the structure which will be in contact with the ridge (hereafter referred to as the ice/cone coefficient of friction); and $R_v$ is the vertical ridge failure force (from FIG. 7).

FIG. 8 is a graphical representation of equation (1) wherein the ice/cone coefficient of friction ($\mu$) equals 0.2. Investigations have indicated that 0.2 is a fairly conservative representation of the coefficient of friction between ice and a smooth metal plate (see "Abrasion-Resistant Coatings And Their Applications To Ice-Transiting Ships" by Major, R. A., Gulick, R. W. and Calabrese, J. S., presented at Chesapeake Section of Society of Naval Architects and Marine Engineers, Feb. 16, 1978). FIG. 8 graphically illustrates equation (1) by expressing the surface slope angle, $\alpha$, of each wall section (ordinate axis) as a function of the ratio (abscissa axis) between the horizontal design force, $R_{hd}$, and the vertical force, $R_v$, selected from FIG. 7.

The maximum elevation required for each wall section is the sum of:

(a) The elevation of the corresponding ridge keel above the sea floor;

(b) the vertical deflection of the ice ridge at failure; and (c) an allowance for the area of contact between the ridge and the sloping surface.

The vertical ridge deflection can be determined from the theory of beams on an elastic foundation as discussed earlier or by other methods well known to those skilled in the art.

An appropriate allowance for the area of contact can be made by estimating the contact area between the ice and structure based on the confined crushing strength of the ice typically found at the bottom of a multiyear ridge.

Figure 9:
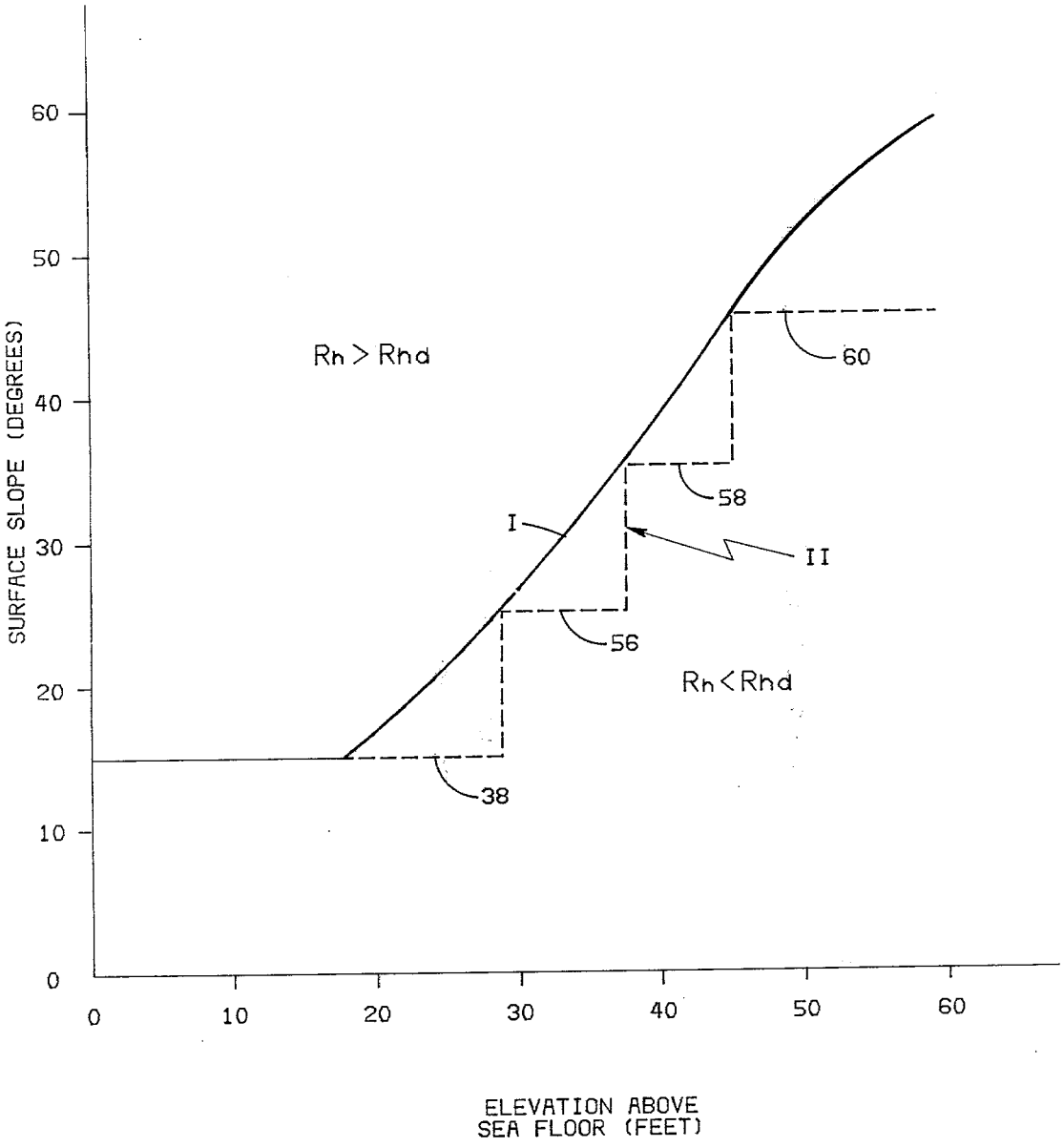
FIG. 9 is a graph of the slope of the surface as a function of ice sheet thickness.

The sum of these three factors is illustrated in FIG. 9. Curve I in FIG. 9 represents a relationship between the maximum surface slope angle of the wall section and its associated maximum elevation for a design horizontal force of 50,000 kips (1 kip=1000 lbs.). Points lying above Curve I represent slope angles greater than those calculated from equation (1). Such combinations of slope angle and elevations will lead to horizontal forces greater than the horizontal design force (i.e., $R_h>R_{hd}$) and should be avoided in design. Points lying below Curve I represent slope angles less than those calculated from equation (1). These combinations of slope angle and elevation will result in maximum horizontal forces less than the design force and are thus acceptable for design.

To minimize the size of a structure designed by this method, its combinations of slope and elevation should be as close to Curve I as possible. That is, its slope angle should increase as rapidly as possible with elevation. FIG. 5 shows a structure in which above a minimum slope (i.e. 15°), the slope angle of the structure varies continuously according to the relationship illustrated by Curve I.

In order to satisfy certain constraints on the shape of the structure and to simplify construction, the structure may be composed of a number of constant sloped conical or wall sections which lie beneath Curve I. Curve II represents such a design. Curves I and II, particularly the selection of the maximum elevation, will be discussed in more detail in the Design Example.

Several shape constraints independent of the design pressure ridge will influence the final shape of the structure. For example, the top surface of the structure must extend sufficiently far above the water surface so that ice does not contact the deck. In addition, when the ice ridge contacts the structure it will crush against the steeper slope until sufficient contact area has developed on the steeper slope to lift the ridge upwardly. This constraint might pose a problem for structures with continuously varying slopes unless the ridge ice has a sufficiently high crushing strength that the contact area is quite small.

Another shape constraint may be caused by the underside profile of the pressure ridge keel. It has been found that the keels of multiyear ridges have a slope of about 30° from the horizontal. This means that conical structures of a constant slope angle greater than 30° will generally come in contact with the upper part of the keel rather than the lower part. And for multiple slope structures the same situation occurs for certain size ridges when the structure slope angle exceeds 30°. Since the design method described herein assumes that the ridge is lifted by the bottom of the keel rather than the top to achieve the bending failure mechanism, it is necessary to limit the slope angle to about 30° for elevations below the bottom of the multiyear floes. However, since multiyear floes are commonly about 15 feet thick, this constraint would not apply for structures in 15 feet or less of water.

When the shape of the cone has been determined as described above and shape constraints have been taken into account, it is possible to determine the base diameter provided the diameter of the column supporting the deck is known. Column diameters for monopod (single leg) structures have ranged from 30 to 50 feet due primarily to the size and function of the deck.

If the foundation capacity is inadequate to handle the anticipated environmental and operating deck loads, it will be necessary to repeat the process described above using a smaller horizontal design force. If the foundation capacity is greater than that needed, it may be possible to reduce the size of the structure by repeating the design process with a larger horizontal design force.

DESIGN EXAMPLE

For purposes of illustrating the above design methodology, assume that the maximum design horizontal force, $R_{hd}$, chosen is 50,000 kips. The elastic beam method, as discussed above, is used to generate a curve as illustrated in FIG. 7. To generate such a curve requires three preliminary assumptions as to the geometry and properties of the ice: the ice sheet thickness, the modulus of elasticity, E, for the ice, and the maximum flexural stress of the ice. For purposes of this example, the ice sheet thickness is assumed to be 15 feet, the modulus of elasticity for the ice is assumed to be 1,000,000 psi, and the maximum flexural strength of the ice is assumed to be 100 psi.

Referring to Table I, a compilation of data from which the curve in FIG. 7 was generated is shown. The first three columns of Table I have been described earlier with respect to the design methodology of the present invention. They are a correlation of the keel depth, the ridge thickness and the corresponding vertical force. The fourth column is the vertical displacement which each ice ridge must undergo to reach a flexure or bending failure stress of 100 psi. As mentioned earlier, the values listed in column 4 are one of three numbers used in the development of the elevation height required for each wall section.

The next step in the design requires the selection of an ice/cone coefficient of friction, $\mu$, and the generation of a curve similar to that illustrated in FIG. 8 using equation (1). The designer will then employ FIG. 7 in combination with the maximum $R_{hd}$ chosen (50,000 kips) to arrive at a design curve as shown in FIG. 9.

Table II is a list of data obtained from FIGS. 7 and 8. The first column is a listing of keel depth which is taken from Table I. For purposes of this design example, a water depth of 70 feet is assumed. The second column is the respective vertical displacement for each keel depth and corresponds to the fourth column of Table I. The third column of Table II is the elevation of the bottom of the keel of the ridge above the sea floor. For example, in a water depth of 70 feet, a 70 foot keel depth ridge is zero feet above the sea floor. Similarly, a pressure ridge having a keel depth of 30 feet is 40 feet above the sea floor. The fourth column is the addition of the second and third columns. This is the elevation of the bottom of the keel above the sea floor that the pressure ridge will be at when it fails in a bending mode. For example, when the 50 foot keel depth ridge has been vertically displaced 5.8 feet, the flexural stress, based on the elastic analysis, equals 100 psi, and the ridge will fail. At this point, the bottom of the 50 foot keel is actually 25.8 feet above the sea floor.

The fifth column of Table II is a list of the vertical forces which correspond to the respective keel depths listed in column 3 of Table I. The sixth column of Table II is a ratio of $R_{hd}/R_V$ (abscicca axis of FIG. 8) and the seventh column is a listing of the cone angle, $\alpha$, for each $R_{hd}/R_V$ value. Cone angle, $\alpha$, values are determined using equation (1) and are visually obtainable by using FIG. 8. For example, with an $R_{hd}/R_V$ ratio of 0.5, the cone angle is approximately 15°.

FIG. 9 is a graphical representation of the cone angle or cone slope (column seven of Table II) versus the total elevation of the ridge above the sea floor (column four of Table II plus 10 feet for "contact allowance"). As noted above, the Design Example is for a structure in 70 feet of water. Therefore, a 70 foot keel depth ridge, which is zero feet above the sea floor, will fail in a bending mode when the ridge is vertically displaced 7.6 feet (column 2 of Table II). However, due to the physical characteristics of ice, the ridge will simultaneously bend upwardly and begin crushing at a contact plane between the ice sheet and the structure. As mentioned above, when contact is made between the ice sheet and the wall of the structure, the edge of the ice fails slightly in crushing as the sheet bends upwardly due to the nature of ice. In analyzing the bending failure of an ice sheets, one assumes a point contact between the sheet and structure. This is satisfactory to determine the vertical load required to fail an ice sheet of a specific thickness. However, in choosing a final design curve a "contact allowance" is selected, which accounts for a plane-type contact rather than the theoretical point-type contact. Investigations have indicated that a reasonable contact allowance is 10 feet. Curve I is the theoretical design shape for the structure tabulated in Table II taking into account an additional 10 feet in the final elevation of each wall section.

The final choices for the profile of the structure are selected from the region below Curve I where $R_h$ is less than $R_{hd}$. As illustrated in FIG. 9, applicants have selected a minimum slope of 15° which, from a fabrication standpoint, is realistically near the minimum slope possible. Size constraints are of concern to the designer since the fabrication and installation expenses associated with the structure are directly related to its size. For this reason 15° is the preferred slope for the lower wall section. Otherwise, the base of the structure would be unduly large in water depths of, for example, over 50 feet. The slopes of the remaining wall sections have been chosen at 10° increments. The incremental increase in each slope is based on practical considerations: minimizing the number of design changes from a fabrication standpoint, yet providing a sufficient number of different slope wall sections to form the multiple slope structure.

MODEL TESTING

A multiple slope model was tested under simulated arctic conditions. The purpose of the test was to determine whether the multiple slope structure interacted with pressure ridges as theoretically predicted. A model was built from steel at a scale of 1/40th of the actual size. All other scale factors for the program, such as pressure ridge thickness, width and length were based on corresponding scaling laws for a geometric scale factor of 40.

Eleven tests were run with pressure ridges embedded in an ice sheet such that the longitudial axis of the ridge was perpendicular to a line extending radially from the center line of the conical structure. These ridges ranged in thickness from 5.51 inches (18.5 feet at full scale) to 16.14 inches (53.8 feet); in width from 18.11 inches (60.4 feet) to 100.78 inches (336.0 feet); and in length from 20.47 inches (68.2 feet) to 177.95 inches (593.2 feet). The thickness of the ice sheet surrounding each ridge varied in thickness from 1.50 inches (5.0 feet) to 4.33 inches (14.4 feet).

It was found during these eleven tests that the pressure ridge first cracked along a vertical plane which extends radially from the center of the structure outwardly. The ridge then developed a hinge crack resulting in several ridge pieces on both sides of the structure which either passed around the structure or advanced up the structure in the bending mode previously described.

Figure 10:
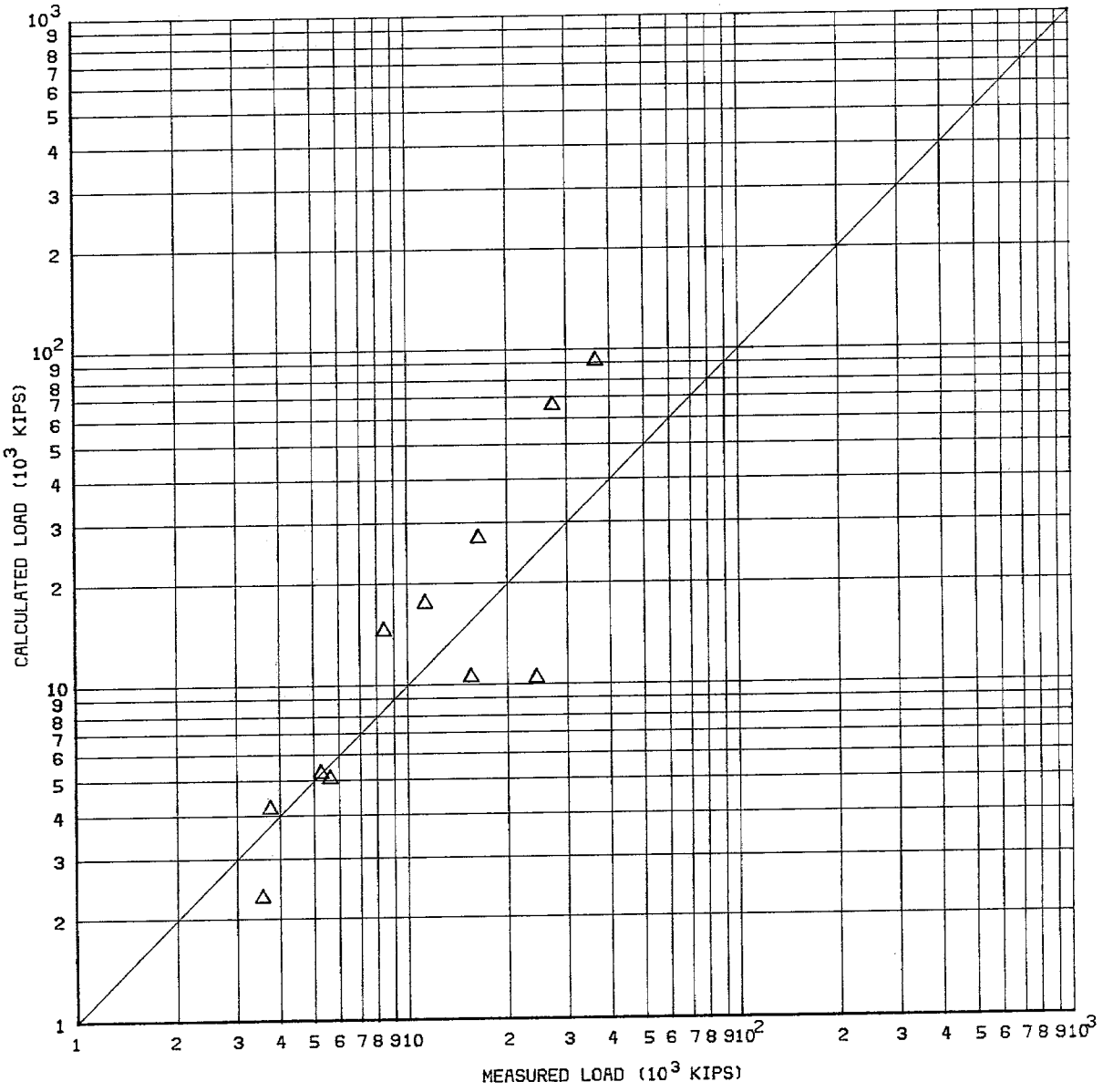
FIG. 10 is a graph comparing the calculated vertical forces to the measured vertical forces on a structure designed in accordance with the present invention.

Model testing led to several important conclusions. The elastic method for determining the vertical forces exerted by ice sheets appears to be reasonably accurate. FIG. 10 is a log-log graph comparing the measured vertical load of the eleven tests mentioned above (see the abscissa of the graph, values scaled up to full) with the calculated vertical loads based on an elastic beam method analysis of similarly sized ridge (see the ordinate on the graph, values scaled up to full). The calculated vertical loads actually plotted in FIG. 10 are not the same as those listed in Table I since the calculated vertical loads in FIG. 10 are for an ice sheet similar in geometry to that actually used in the model tests. Secondly, the model tests indicated that the preferred embodiment for the invention when used in water depths of 60 feet or less is a bi-angle or two-slope structure having a single break. Typically, the design pressure ridge in these water depths has a keel depth equal to the water depth. In other words, the bottom of the ridge touches the sea floor as it moves. In such event, as mentioned above, the underside profile at the leading portion of the ridge may influence the final shape of the structure.

Figure 11A:
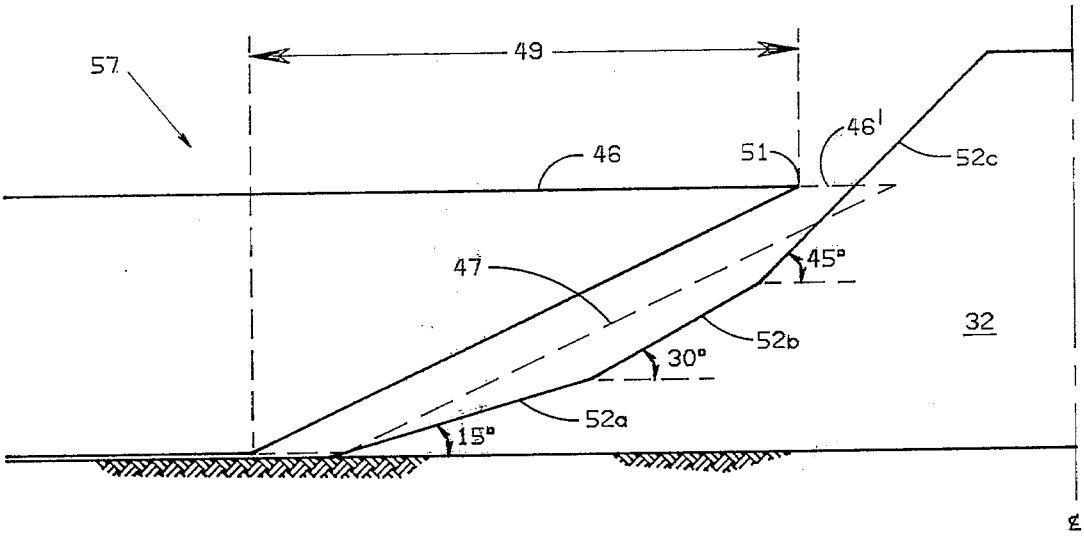
FIGS. 11A and 11B illustrate the collision of a pressure ridge with the embodiment of the present invention.
Figure 11B:
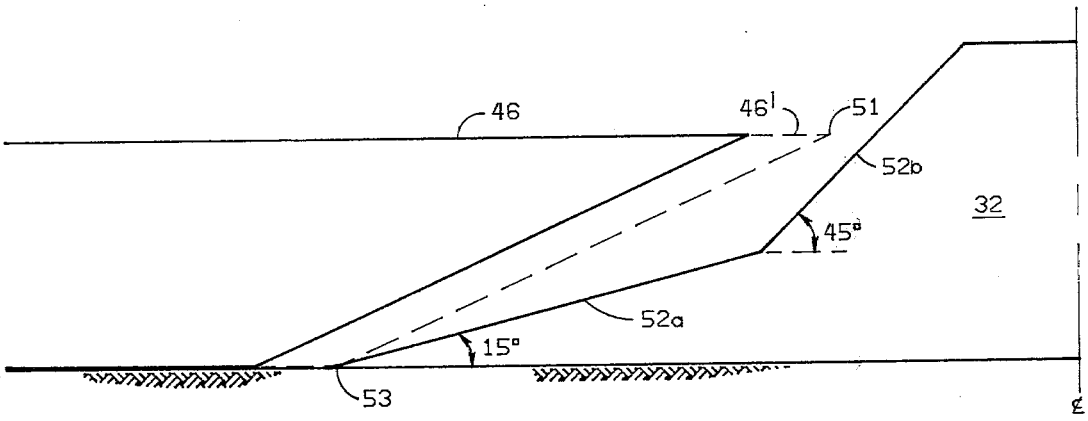

To explain this last occurrence, reference is made to FIGS. 11A and 11B. FIG. 11A illustrates a profile view of a substructure 32 having three wall sections 52*a*–52*c* of slopes 15°, 30° and 45° from the horizontal. A leading portion 57 of the design pressure ridge 46 is shown in solid lines immediately before it contacts the substructure 32. The dashed line 46′ shows the ridge after it collides with the substructure. The underside profile 47 of the pressure ridge at this depth (60 feet or less) generally has a slope greater than 15°, typically 20°–40°. Therefore, depending on the length 49 of the slope, the ridge may initially contact the substructure on the steeper sloped wall section 52*c* as illustrated in FIG. 11A (the 45° sloped wall sections) rather than the lesser sloped wall section 52*a* (15 sloped wall sections). This could hamper the initiation of a bending failure mode until the upper edge 51 is crushed slightly to permit contact between the ridge and lesser sloped wall section 52*a*. Moreover, the upper edge 51 may be deflected upwardly while it is crushing; further delaying contact between the lesser sloped wall section 52*a* and the ridge. This situation can be corrected by modifying the shape of the structure as illustrated in FIG. 11B. A bi-sloped or two-sloped structure permits the design pressure ridge 46 to initially contact the substructure 32 on its lesser sloped wall section 52*a*. The upper edge 51 does not contact the structure. Rather, the leading portion of the ridge is deflected upwardly in a bending failure mode.

As mentioned above, a small amount of crushing occurs regardless of the contact point. Therefore, a "contact allowance" is included in the final elevation height selected for each wall section. As discussed in the Design Example, a "contact allowance" of 10 feet in the elevation of the wall section is reasonable. The model tests have indicated that even with slight crushing at the lower edge 53 of the leading portion, a "contact allowance" of 10 feet will still provide sufficient distance between the upper edge 51 and the substructure (in the case of FIG. 11B, wall section 52*b*) to avoid contact.

In summary, the model tests indicate that the lower wall section 52*a* should have a slope between 10° and 20° from the horizontal, preferably 15° from the horizontal. The upper wall section 52*b* should have a slope between 40° and 70° from the horizontal, preferably 45° from the horizontal. In addition, the single break should be between 5 feet and 30 feet below the water surface, preferably 15 feet below the surface.

In selecting the maximum horizontal load which can be tolerated on the structure, an adfreeze phenomenon which occurs between ice and metal in an arctic environment should be considered. Adfreeze is the tendency of an ice sheet to adhere to the outer surface of an offshore structure. This produces a horizontal and vertical load on the structure, depending on the slope of the wall section, which must be overcome for the ice sheet to advance up the surface. Thus, to permit a smooth bending failure mode mechanism, ice adhesion should be minimized. To provide for such, the outer surface of the structure may be chemically treated or heated. Chemically, the outer surface may be coated with a thin film of polymeric material 70 (see FIG. 6) such as polyurethane. In this manner, the contacting surface has a lower adhesion factor and, therefore, a lower adfreeze load. Alternatively, the surface may be heated by thermal panels 80 (see FIG. 6) located on the inside of the structure adjacent the wall sections. These panels elevate the temperature of the metal thereby inhibiting the adfreeze phenomenon.

The present invention has been described in terms of various embodiments. Modifications and alterations to these embodiments will be apparent to those skilled in the art in view of this disclosure. It is, therefore, applicants' intention to cover all such equivalent modifications and variations which fall within the spirit and scope of this invention.

TABLE I

| 1. Keel Depth (KD) (Ft) | 2. Ridge Thickness (FT) | 3. Vertical Force, $R_V$ (FIG. 7) ($10^3$ KIPS) | 4. Vertical Displacement (Ft) |
|---|---|---|---|
| 70 | 91 | 100 | 7.6 |
| 65 | 85 | 85 | 7.2 |
| 60 | 78 | 72 | 6.7 |
| 55 | 72 | 60 | 6.3 |
| 50 | 65 | 50 | 5.8 |
| 45 | 59 | 40 | 5.3 |
| 40 | 52 | 32 | 4.9 |
| 35 | 46 | 26 | 4.5 |
| 30 | 39 | 20 | 4.2 |
| 25 | 33 | 17 | 4.1 |

TABLE II

| 1. Keel Depth, (KD) (Feet) | 2. Displacement, (VD) at Failure (Feet) | 3. Elevation of Bottom of Keel Above Sea Floor (Water Depth) (KD) (Feet) | 4. Total Elevation of Keel Above Sea Floor at Failure (Feet) | 5. Vertical Force, $R_V$ (FIG. 7) ($10^3$ KIPS) | 6. $R_H/R_V$ | 7. Cone Angle, $\alpha$, (FIG. 8) (Degrees) |
|---|---|---|---|---|---|---|
| 70 | 7.6 | 0 | 7.6 | 100 | 0.50 | 15 |
| 60 | 6.7 | 10 | 16.7 | 72 | 0.69 | 23 |
| 50 | 5.8 | 20 | 25.8 | 50 | 1.00 | 33 |
| 40 | 4.9 | 30 | 34.9 | 32 | 1.56 | 46 |
| 30 | 4.2 | 40 | 44.2 | 20 | 2.50 | 57 |

What is claimed is:

1. An offshore structure suitable for placement on the sea floor in a body of water having moving ice masses of various thicknesses, said structure comprising:

a superstructure located above the waterline for conducting working operations; and a transportable substructure supporting said superstructure, said substructure including a foundational base, an internal frame assembly, and an inwardly and upwardly sloping outer wall to engage the ice masses, said wall having three ice-engaging wall sections with slopes arranged so that the slopes of said wall sections become progressively steeper towards the upper end of said substructure, the uppermost ice-engaging wall section having a slope not exceeding 70° to the horizontal, the middle ice-engaging wall section, adapted to lie completely below the waterline, having a slope of about 30° to the horizontal and the lowermost ice-engaging wall section having a slope of between 10° and 30° to the horizontal, whereby thicker ice masses initially contact the middle and lowermost wall sections and thinner ice masses initially contact the uppermost and middle wall sections.

2. The structure of claim 1 wherein the slope of the uppermost ice-engaging wall section is between 40° and 70° to the horizontal and the slope of the lowermost ice-engaging wall section is between 10° and 20° to the horizontal.

3. The structure of claim 2 wherein the slope of the lowermost wall section is about 15° to the horizontal.

4. The structure of claim 2 wherein the slope of the uppermost wall section is about 45° to the horizontal.

5. An offshore structure suitable for placement on the sea floor in a body of water having moving ice masses of various thicknesses, said structure comprising:

a superstructure located above the waterline for conducting working operations; and a transportable substructure supporting said superstructure, said substructure including a foundational base, an internal frame assembly, and an inwardly and upwardly sloping outer wall to engage the ice masses, said wall having a plurality of ice-engaging wall sections with different slopes arranged so that the slopes of said wall sections become progressively steeper towards the upper end of said substructure, each of said wall sections being curved and merging into its adjacent wall section to define a continuously varying outer ice-engaging wall surface with at least one point on the slope of said wall sections below the waterline being between 10° and 30° to the horizontal and no point on the slope of said wall sections below the waterline being less than 10° or more than 70° to the horizontal, whereby thicker ice masses initially contact the wall sections nearer the sea floor and thinner ice masses initially contact the wall sections nearer the waterline.

6. The structure of claim 1 or 5 wherein said base is adapted to rest on the sea floor.

7. The structure of claim 1 or 5 wherein said base is adapted to be embedded in the sea floor.

8. A method for determining the profile shape of a multiple slope structure suitable for placement on the sea floor in a body of water having floating ice masses of varying thicknesses, said structure having at least a first and second wall section wherein said method comprises the steps of:

(a) selecting a range of floating ice masses indigenous to said body of water, each said floating ice mass being generally planar but having a first and second portion, said first portion being substantially thicker and generally protruding above and below a thinner second portion, the thicknesses of said first and second portions being determined by measurements of said ice masses in said body of water;

(b) determining a horizontal design force, $R_{hd}$, not to be exceeded by each of said floating ice masses within said range;

(c) determining a vertical force, Rv, required to fail in flexure each portion of each of said floating ice masses within said range;

(d) determining a maximum slope from the horizontal, $\alpha$, for each floating ice mass within said range according to the following equation:

$$\alpha = \tan^{-1} (R_{hd}/Rv - \mu)(1 + \mu R_{hd}/Rv)$$

wherein $\mu$ is the coefficient of friction between said floating ice mass and the surface of said wall section; and (e) selecting the profile shape of said structure by:

(1) selecting a slope for each of said wall sections wherein each such slope being less than or equal to said corresponding maximum slope, $\alpha$, and (2) determining a final elevation for each of said wall sections above the sea floor, said elevation being a sum of the elevation of said ice mass above the sea floor at the point of contact with said each wall section, the vertical deflection of each portion of said ice masses when said portion fails to flexure, and a predetermined amount to accommodate an allowance for the area of contact between said ice mass and said each wall section.

9. A method for fabricating a multiple slope structure suitable for placement on the sea floor in a body of water having floating ice masses of varying thicknesses, said structure having at least a first and second wall section wherein said method comprises the steps of:

(a) selecting a range of floating ice masses indigenous to said body of water, each said floating ice mass being generally planar but having a first and second portion, said first portion being substantially thicker and generally protruding above and below a thinner second portion, the thicknesses of said first and second portions being determined by measurements of said ice masses in said body of water;

(b) determining a horizontal design force, $R_{hd}$, not to be exceeded by each of said floating ice masses within said range;

(c) determining a vertical force, Rv, required to fail in flexure each portion of each of said floating ice masses within said range;

(d) determining a maximum slope from the horizontal, $\alpha$, for each floating ice mass within said range according to the following equation:

$$\alpha = \tan^{-1} (R_{hd}/Rv - \mu)(1 + \mu R_{hd}/Rv)$$

wherein $\mu$ is the coefficient of friction between said floating ice mass and the surface of said wall section;

(e) selecting the profile shape of said structure by:

(1) selecting a slope for each of said wall sections wherein each such slope being less than or equal to said corresponding maximum slope, $\alpha$, and (2) determining a final elevation for each of said wall sections above the sea floor, said elevation being a sum of the elevation of said ice mass above the sea floor at the point of contact with said each wall section, the vertical deflection of each portion of said ice masses when said portion fails in flexure, and a predetermined amount to accommodate an allowance for the area of contact between said ice mass and said each wall section; and (f) fabricating a multiple slope structure having a profile shape as determined by steps (a) through (e).

* * * * *